US006145723A

United States Patent [19]

Gupta

[11] Patent Number: 6,145,723

[45] **Date of Patent: *Nov. 14, 2000**

[54] WORKPIECE-CONTACTING PROBE FOR FASTENER-DRIVING TOOL FOR FASTENING DIMPLED MEMBRANES TO FOUNDATION WALLS VIA FASTENERS AND POLYMERIC PLUGS

[75] Inventor: Harish C. Gupta, Naperville, Ill.

[73] Assignee: Illinois Tool Works Inc., Glenview, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/014,253

[22] Filed: Jan. 27, 1998

[51] Int. Cl.[7] ..... B25C 1/04

[52] U.S. Cl. ..... 227/8; 227/113; 227/119; 227/139; 227/147

[58] Field of Search ..... 227/8, 119, 120, 227/113, 147, 15, 43, 139, 149; 81/125, 23

[56] References Cited

U.S. PATENT DOCUMENTS

| | | | |
|---|---|---|---|
| 225,482 | 3/1880 | Mower | 227/147 |
| 2,724,303 | 11/1955 | Holcomb | 411/903 |
| 2,895,135 | 7/1959 | Hilti | 227/147 |
| 2,902,690 | 9/1959 | Hamlin | 227/147 |
| 2,925,602 | 2/1960 | Kopf | 227/8 |
| 2,973,520 | 3/1961 | Bell | 227/147 |
| 3,060,440 | 10/1962 | Pfaff | 227/147 |
| 3,602,419 | 8/1971 | Doberne | 227/147 |
| 3,612,378 | 10/1971 | Pabich et al. | 227/8 |
| 3,707,894 | 1/1973 | Stillwagon | 81/125 |
| 3,734,377 | 5/1973 | Munn | 227/120 |
| 3,854,536 | 12/1974 | Hallock | 227/7 |
| 4,074,844 | 2/1978 | Hodil | 227/8 |
| 4,227,637 | 10/1980 | Haytayan | 227/8 |
| 4,252,260 | 2/1981 | Burton | 227/149 |
| 4,339,065 | 7/1982 | Haytayan | 227/8 |
| 4,485,952 | 12/1984 | Weis | 227/7 |
| 4,485,956 | 12/1984 | Van Iperen | 227/147 |
| 4,519,536 | 5/1985 | Steigauf | 227/149 |
| 4,562,948 | 1/1986 | Floyd | 227/113 |
| 4,809,568 | 3/1989 | DeCaro | 227/149 |
| 4,838,471 | 6/1989 | Chiesa | 227/147 |
| 5,042,142 | 8/1991 | Beach et al. | 227/120 |
| 5,069,340 | 12/1991 | Ernst | 227/147 |
| 5,443,345 | 8/1995 | Gupta | 411/441 |
| 5,484,094 | 1/1996 | Gupta | 227/8 |

*Primary Examiner*—Peter Vo
*Assistant Examiner*—Jim Calve
*Attorney, Agent, or Firm*—Rockey, Milnamow & Katz, Ltd.

[57] ABSTRACT

A combustion-powered, fastener-driving tool useful to fasten a dimpled membrane to a foundation wall, via a fastener and a polymeric plug, is arranged to drive a fastener from a nosepiece, through the plug and the membrane, into the wall. An actuating member mounted movably on the tool is movable thereon between an extended, tool-disabling position and a retracted, tool-enabling position. A workpiece-contacting probe is mounted to the actuating member so as to be conjointly movable with the actuating member. The probe includes a plug-holding member adapted to hold the plug as the fastener is being driven, having a tubular wall defining a recess adapted to receive the plug, and having two pointed elements in diametric opposition to each other, each having a point projecting inwardly from the tubular wall so as to press against the plug received in the recess. The workpiece-contacting probe includes a mounting bracket mounted to the actuating member. In one embodiment, the plug-holding member is fixed to the mounting bracket. In another embodiment, in which the workpiece-contacting probe includes a tubular body fixed to the mounting bracket with a pair of permanent magnets positioned at opposite sides of the tubular body, the plug-holding member is mounted removably to the tubular body and is held magnetically. The magnets are adapted to hold a steel washer, which is made of a magnetizable steel, when the plug-holding member is removed.

5 Claims, 3 Drawing Sheets

40'
34'
36'
38'
32'
20'
22'
12
200
14
18
30'
16
224
222
44
42
10
210
202
212
220
240
230
242
244
22'
20
N
S
214
36'

WORKPIECE-CONTACTING PROBE FOR FASTENER-DRIVING TOOL FOR FASTENING DIMPLED MEMBRANES TO FOUNDATION WALLS VIA FASTENERS AND POLYMERIC PLUGS

TECHNICAL FIELD OF THE INVENTION

This invention pertains to a workpiece-contacting probe for a fastener-driving tool, such as a combustion-powered, fastener-driving tool, which is useful to fasten dimpled membranes to foundation walls via fasteners, such as steel pins, and via polymeric plugs. The probe is adapted to hold each plug via one or more pointed elements provided on the probe and to enable such plug to be properly positioned in a dimple as a fastener is driven through such plug, into a foundation wall, by the tool.

BACKGROUND OF THE INVENTION

Dimpled membranes formed from high density polyethylene (HDPE) are known for dampproofing of foundation walls, such as poured concrete, concrete block, or preserved wood walls. Typically, such a membrane is formed with an array of similar dimples, which are adapted to rest against a foundation wall so as to space the membrane from the foundation, except where the dimples rest against the foundation wall, whereby to provide an air gap serving as a drainage space for moisture entering the air gap from inside or outside the membrane.

Typically, when such a membrane is installed on a foundation wall, polymeric plugs having preformed holes are inserted into selected dimples and steel pins are driven through the plugs via the preformed holes, through the membrane at the dimples having the plugs, into the foundation wall. The plugs are intended to provide seals where the pins are driven through the membrane. It is known for such membranes to be manually installed by workers using hammers to drive the pins.

As described above, dimpled membranes and polymeric plugs for such membranes are available commercially from Big "O" Inc. of Exeter, Ontario, under the "System Platon" designation, and from Casella Dorken Products, Inc. of Beamsville, Ontario, under the "Delta-MS" designation. Steel washers and steel pins are specified by Big "O" Inc. for upper margins of "System Platon" membranes.

In the prior art, an attempt was made to enable a worker to use a fastener-driving tool, such as combustion-powered, fastener-driving tool, by adapting the workpiece-contacting probe illustrated and described in Gupta U.S. Pat. No. 5,484,094 not only to work with steel washers, as disclosed therein, but also to work with polymeric plugs described above. As illustrated and described therein, the probe has two permanent magnets to hold a washer plate with or without a central aperture, as a fastener, such as a steel pin or a wire nail, is driven through the washer plate into a substrate.

In the attempt that was made, a workpiece-contacting probe was provided not only with two permanent magnets adapted to hold a steel washer but also with a collet having several plug-holding fingers intended to hold a polymeric plug. The workpiece-contacting probe had relatively movable elements that were arranged to be manually adjustable between a washer-holding condition, in which the magnets were to be used, and a plug-holding condition, in which the fingers were to be used.

In the attempt that was made, the workpiece-contacting probe proved to be generally unsatisfactory. One problem was that its movable elements tended to become plugged with mud or debris. Another problem was that the fingers did not work satisfactorily over the wide range of dimensional tolerances of the polymeric plugs that were available commercially.

SUMMARY OF THE INVENTION

Addressing such problems, this invention provides a successful adaption of the workpiece-contacting probe illustrated and described in Gupta U.S. Pat. No. 5,484,094 not only to work with steel washers, as disclosed therein, but also to work with polymeric plugs described above.

This invention provides a fastener-driving tool that is modified, as compared to known fastener-driving tools, so as to be particularly useful to fasten a dimpled membrane to a foundation wall, via a fastener and a polymeric plug.

The fastener-driving tool is similar to known fastener-driving tools in comprising a nosepiece, means for driving the fastener from the nosepiece, through the polymeric plug and through the dimpled membrane, into the foundation wall, an actuating member mounted movably on said tool and movable thereon between an extended, tool-disabling position and a retracted, tool-enabling position, and a workpiece-contacting probe mounted to the actuating member so as to be conjointly movable with the actuating member.

As modified by this invention, the workpiece-contacting probe includes a plug-holding member adapted to hold the polymeric plug as the fastener is being driven. The plug-holding member defines a recess adapted to receive the polymeric plug. The plug-holding member also has at least one pointed element having a point projecting inwardly from the tubular wall, into the recess, so as to press against the polymeric plug when the polymeric plug is received in the recess.

Preferably, the at least one pointed element comprises a pair of pointed elements in diametric opposition to each other, each having a point projecting inwardly from the tubular wall so as to press against the polymeric plug when the polymeric plug is received in the recess. Preferably, moreover, each pointed element comprises a pointed pin extending through the tubular wall and having a point projecting inwardly from the tubular wall, into the recess.

Presently, two different embodiments are contemplated, in each of which the work-contacting probe includes a mounting bracket mounted to the actuating member. In a first embodiment, which is simpler, the plug-holding member is fixed to the mounting bracket.

In a second embodiment, which is more complex, the workpiece-contacting probe also includes a tubular body fixed to the mounting bracket. Further, the tubular body includes at least one permanent magnet positioned at one side of the tubular body, preferably two permanent magnets positioned at opposite sides of the tubular body. The plug-holding member, which is mounted removably to the tubular body, has a portion made from a magnetizable steel and held magnetically by the permanent magnet or magnets when mounted to the tubular body.

In the second embodiment, the permanent magnet or magnets is or are adapted to hold a steel washer, which is made from a magnetizable steel, when the plug-holding member is removed. In the second embodiment, except for the plug-holding member, the workpiece-contacting probe is similar to the workpiece-contacting probe disclosed in Gupta U.S. Pat. No. 5,484,094.

These and other objects, features, and advantages of this invention are evident from the following description of the aforenoted embodiments, with reference to the accompanying drawings.

BRIEF DESCRIPTION OF THE DRAWINGS

FIG. 14 of the accompanying drawings illustrates the probe P discussed in the preceding paragraphs in its washer-holding condition, a washer W being illustrated as spaced from the probe P.

FIG. 15 thereof illustrates the probe P as changed from its washer-holding condition, a polymeric probe PP being illustrated as spaced from the probe P.

FIG. 16 thereof illustrates the probe P as illustrated in FIG. 15, except that the polymeric plug PP is illustrated as being held by probe-holding fingers F of the probe P.

DETAILED DESCRIPTION OF THE PREFERRED EMBODIMENT

Figure 1:
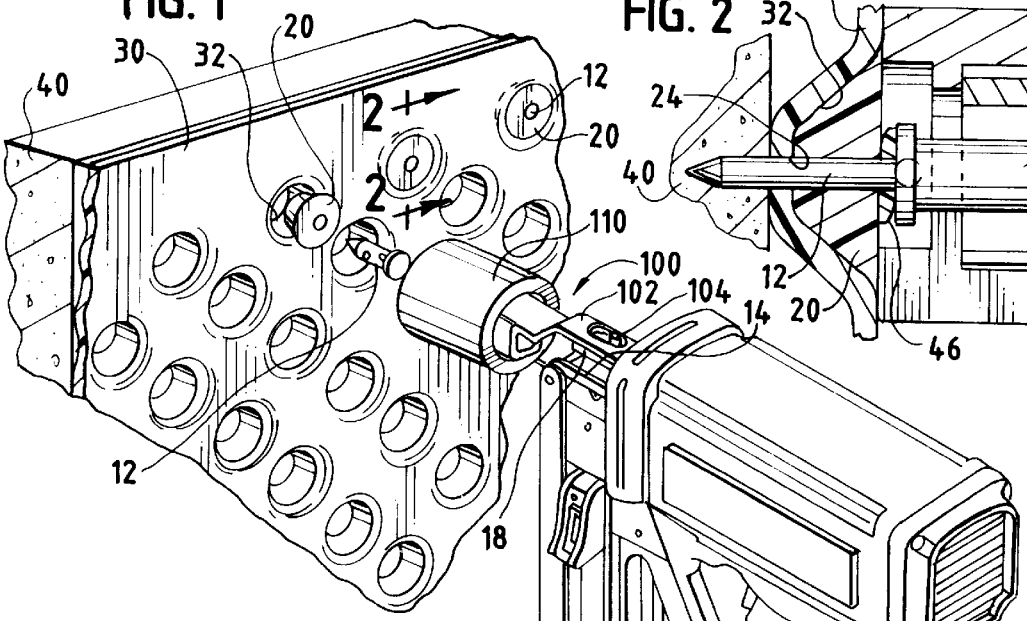
FIG. 1 is a partly exploded, perspective view of a fastener-driving tool including a workpiece-contacting probe according to the first embodiment of this invention, as used to fasten a dimpled membrane to a foundation wall, via fasteners and polymeric plugs.
Figure 2:
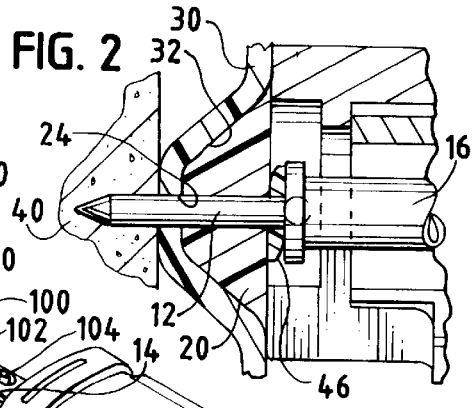
FIG. 2, on a larger scale, is a fragmentary, sectional view taken along line 2—2 of FIG. 1, in a direction indicated by arrows. A fastener and a polymeric plug are shown and the fastener-driving tool is shown fragmentarily with the workpiece-contacting probe contacting the dimpled membrane.
Figure 3:
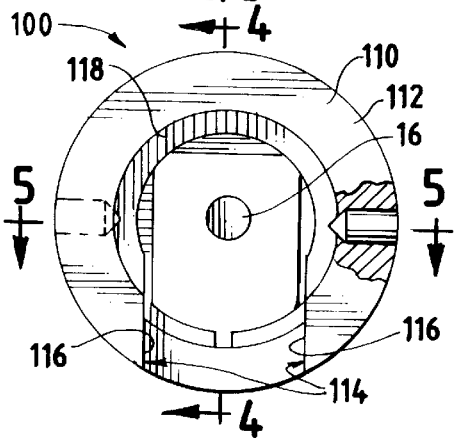
FIG. 3, on a similar scale, is a partly broken away, axial view of the workpiece-contacting probe, as seen from the left end of FIG. 2. The fastener and the polymeric plug are not shown.
Figure 3:
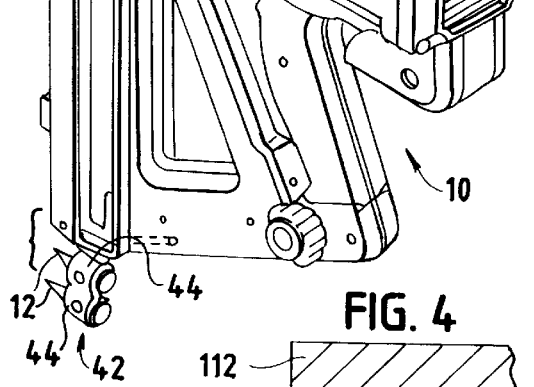
Figure 4:
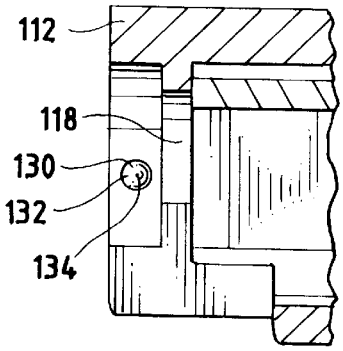
FIG. 4 is a fragmentary, sectional view of the work-contacting probe, as taken along line 4—4 of FIG. 3, in a direction indicated by arrows.
Figure 6:
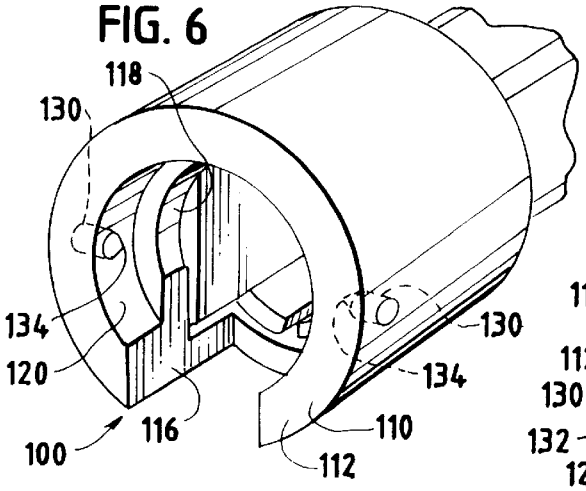
FIG. 6 is a fragmentary, perspective view of the workpiece-contacting probe, as shown in FIGS. 3, 4, and 5.

As shown in FIG. 1, a fastener-driving tool 10 is being used to drive a steel pin 12 from a nosepiece 14 of the tool 10, through a polymeric plug 20, through a dimpled membrane 30 at a selected dimple 32, into a foundation wall 40, which can be alternatively made of poured concrete, as shown, of concrete block, or of preserved wood. As shown in FIGS. 2 and 3, the tool 10 has a driving ram 16, which is driven forcibly so as to drive the steel pin 12. The membrane 30 is shown in FIG. 1 as having been fastened to the foundation wall 40 via two similar pins 12 driven through two similar plugs 20.

As shown in FIG. 1, the membrane 30 is formed from a sheet of high density polyethylene (HDPE) so as to have a rectangular array of similar dimples 32, each having a generally frusto-conical shape, and is intended to represent the "Delta-MS" membranes described above as being available commercially from Casella Dorken Products, Inc. The dimples 32 are closed except where selected dimples 32 are penetrated by the pins 12. The plugs 20 seal the dimples 32 that are penetrated by the pins 12.

Figure 5:
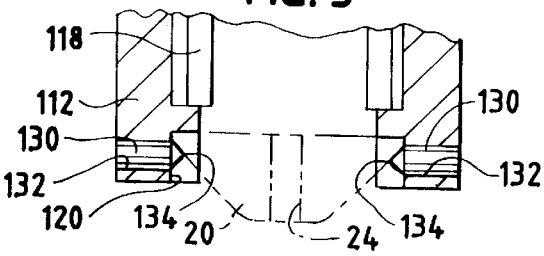
FIG. 5 is a fragmentary, sectional view of the work-contacting probe, as taken along line 5—5 of FIG. 3, in a direction indicated by arrows. A polymeric plug is shown in broken lines.

As shown in FIGS. 1, 2, and 5, each plug 20 is molded from a suitable polymer, such as high density polyethylene, so as to have a generally frusto-conical shape, and each plug 20 is intended to represent the polymeric plugs described above as being available commercially from Casella Dorken Products, Inc. for such "Delta-MS" membranes. Defining an axis, each plug 20 has a preformed hole 24, which extends axially through such plug 20 and through which such a pin 12 can be forcibly driven. Further details of the membrane 30 and the plugs 20 are outside the scope of this invention and can be readily supplied by persons having ordinary skill in the art.

Preferably, if steel pins are used as fasteners because the foundation wall 40 is made of poured concrete or concrete block, the fastener-driving tool 10 is a combustion-powered tool of a type exemplified in Nikolich U.S. Pat. No. 5,197,646 and arranged to drive steel pins, as available commercially from ITW Ramset/Red Head (a unit of Illinois Tool Works Inc.) of Wood Dale, Ill. The disclosure of Nikolich U.S. Pat. No. 5,197,646 is incorporated herein by reference.

Preferably, as shown in FIG. 1, the steel pin 12 is fed into the tool 10 via a strip 42, in which a large number of such pins 12 are carried by polymeric sleeves 44, as illustrated and described in Ernst et al. U.S. Pat. No. 5,069,340. As shown in FIG. 2, a collar 46 is formed around the shank of the steel pin 12, between the head of the steel pin 12 and the polymeric plug 20, from residue of the strip 42. The disclosure of Ernst et al. U.S. Pat. No. 5,069,340 is incorporated herein by reference.

Alternatively, if steel pins are used as fasteners because the foundation wall 40 is made of poured concrete or of concrete block, the fastener-driving tool 10 is a powder-actuated tool of a type employing a powder charge and available commercially from ITW Ramset/Red Head, supra.

Alternatively, if wire nails are used as fasteners because the foundation wall 40 is made from preserved wood, the fastener-driving tool 10 is a combustion-powered tool of the type discussed above, as arranged to drive wire nails and as available commercially from ITW Paslode (a unit of Illinois Tool Works Inc.) of Vernon Hills, Ill., or a pneumatically powered tool of a type exemplified in Golsch U.S. Pat. No. 4,932,480, the disclosure of which is incorporated herein by reference.

Conventionally, a fastener-driving tool of any of the types mentioned above has a workpiece-contacting member, which must be firmly pressed against a workpiece, against a spring biasing force, so as to enable the fastener-driving tool to be further actuated for driving a fastener. This invention provides two contemplated embodiments of a workpiece-contacting element that replaces the workpiece-contacting member that would be conventionally employed.

As shown fragmentarily in FIG. 1, the fastener-driving tool 10 has an actuating member 18, which must be inwardly pressed against a workpiece, against a spring biasing force, so as to enable the fastener-driving tool 10 to be further actuated for driving a fastener, such as the steel pin 12. The actuating member 18 is similar to the actuating member of the fastener-driving tool illustrated and described in Gupta U.S. Pat. No. 5,484,094, the disclosure of which is incorporated herein by reference. As illustrated and described in Gupta U.S. Pat. No. 5,484,094, the actuating member 18 is mounted movably on the fastener-driving tool 10, on which the actuating member 18 is movable between an extended, tool-disabling position and a retracted, tool-enabling position.

As shown in FIGS. 1 through 5, the workpiece-contacting probe 100 in its first embodiment includes a mounting bracket 102, which is mounted to the actuating member 18 via two machine screws 104, which pass through an elongate slot 106 in the mounting bracket 102, as illustrated and described in Gupta U.S. Pat. No. 5,484,094. Further, the workpiece-contacting probe 100 includes a plug-holding member 110, which is fixed to the mounting bracket 102.

The plug-holding member 110 has a tubular wall 112 defining an axis. The tubular wall 112 has a gap 114 defining two walls 116 parallel to each other and to the axis defined by the tubular wall 112. The plug-holding member 110 has an annular structure 118 projecting inwardly from the tubular wall 112 and terminating at the walls 116. The tubular wall 112 and the annular structure 118 define a recess 120, which is adapted to receive a polymeric plug 20. Further, the plug-holding member 110 has two pointed pins 130 extending and force-fitted through pin-receiving holes 132 in the tubular wall 112, in diametric opposition to each other. Each pin 130 has a point 134 projecting inwardly from the tubular wall 112 so as to press against and retain a polymeric plug 20 when received in the recess 120. As evident from FIG. 5, the pins 130 hold the polymeric plug 20 in the recess 120, by projecting inwardly from the tubular wall 112 for a sufficient distance to prevent the polymeric plug 20 from exiting the recess 120 until the polymeric plug 20 is driven from the recess.

Being molded from high density polyethylene, each polymeric plug 20 exhibits sufficient resiliency to enable such polymeric plug 20 to be snap-fitted past the points 134, not only when pressed manually into the recess 120 but also when driven forcibly from the recess 120 by a steel pin 12 being driven forcibly by the fastener-driving tool 10, without any significant damage to such polymeric plug 20. The gap 114 facilitates pressing a polymeric plug 20 manually into the recess 120 or removing a polymeric plug 20 manually from the recess 120. As evident from FIG. 5, a polymeric plug 20 has an axial length greater than the axial depth of the recess 120 so as to project axially from the recess 120 when pressed into the recess 120, whereby to facilitate centering of the projecting plug 20 in a dimple 32.

Figures 7, 8, 9, 10, 11, 12, 13:
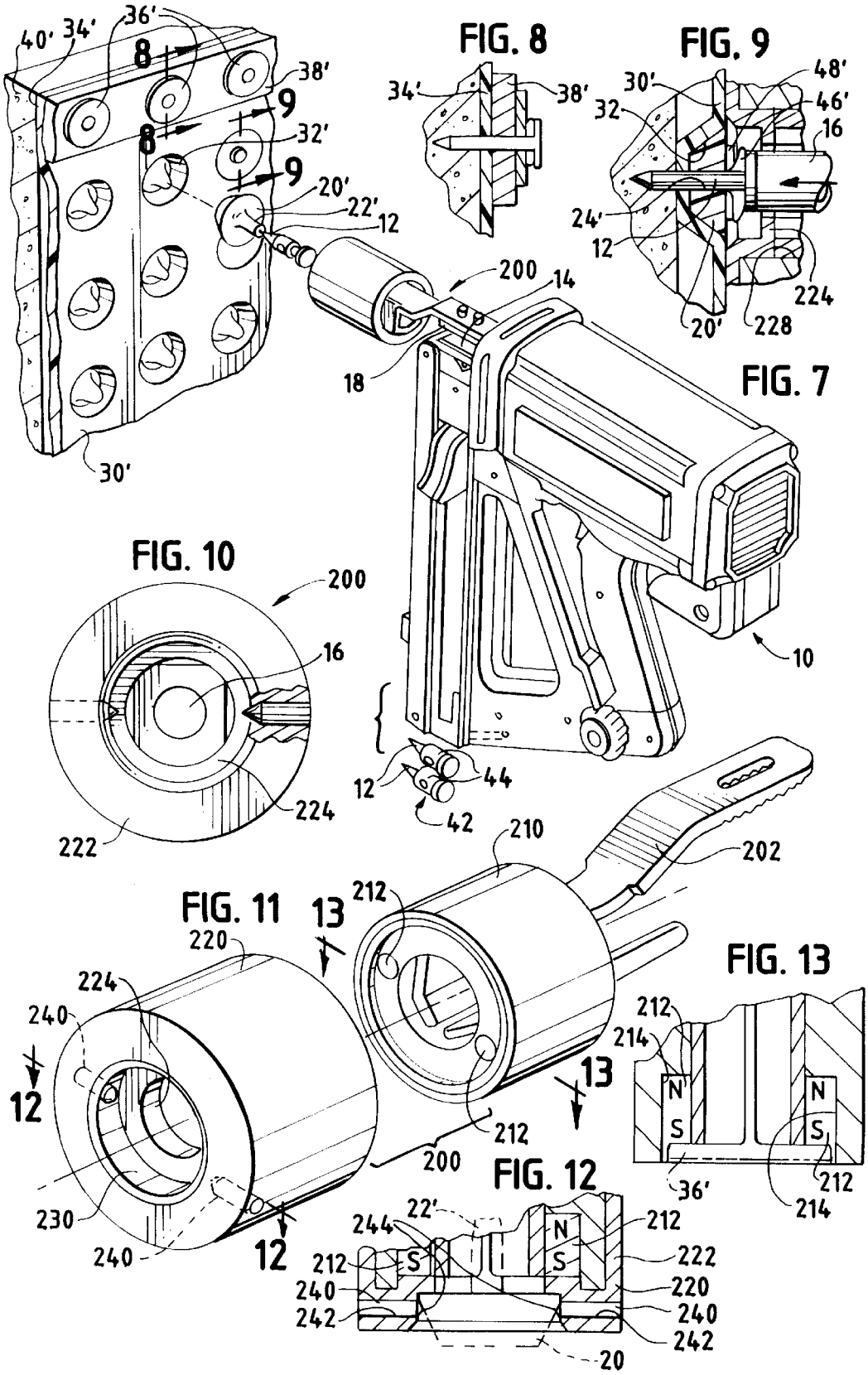
FIG. 7 is a partly exploded, perspective view of a fastener-driving tool including a workpiece-contacting probe according to the second embodiment of this invention, as used to fasten a dimpled membrane to a foundation wall, via fasteners, steel washers, and a steel batten along an upper edge of the dimpled membrane and via fasteners and polymeric plugs elsewhere on the dimpled membrane.
FIG. 8, on an enlarged scale, is a fragmentary, sectional view taken along line 8—8 of FIG. 7, in a direction indicated by arrows. A fastener, a steel washer, the steel batten, and the upper edge of the dimpled membrane are shown, as fastened to the foundation wall.
FIG. 9, on a similar scale, is a fragmentary, sectional view taken along line 9—9 of FIG. 7, in a direction indicated by arrows. A fastener, a polymeric plug, and the dimpled membrane are shown, as fastened to the foundation wall, and the fastener-driving tool is shown fragmentarily with the workpiece-contacting probe contacting the dimpled membrane.
FIG. 10 is a partly broken away, axial view of the workpiece-contacting probe, as seen from the left end of FIG. 9. The fastener and the polymeric plug are not shown.
FIG. 11 is a partly exploded, perspective view of the workpiece-contacting probe, as shown in FIGS. 7, 9, and 10. A mounting bracket, a tubular body fixed to the mounting bracket, and a plug-holding member mounted removably to the tubular body are shown with the plug-holding member shown as removed from the tubular body.
FIG. 12 is a fragmentary, sectional view of the plug-holding member, as taken along line 12—12 of FIG. 11, in a direction indicated by arrows. A polymeric plug is shown in broken lines.
FIG. 13 is a fragmentary, sectional view of the tubular body, as taken along line 9—9 of FIG. 7, in a direction indicated by arrows. A steel washer is shown in broken lines.
Figure 14:
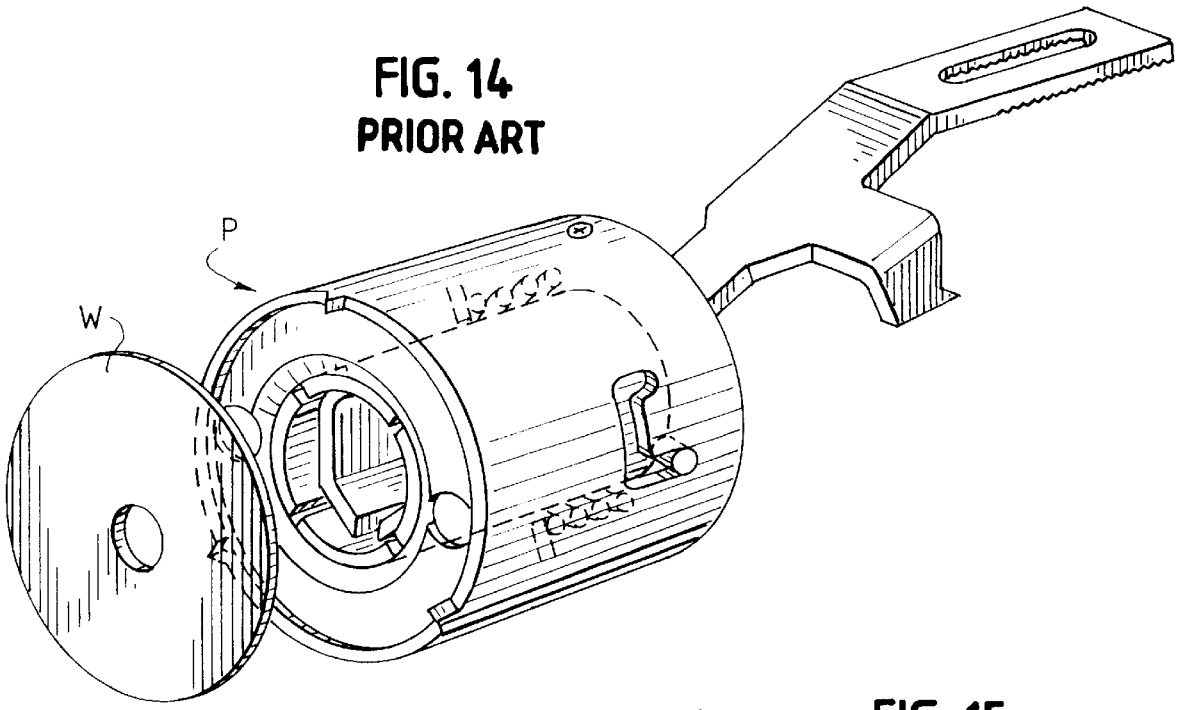
FIG. 14 PRIOR ART
FIGS. 14, 15, and 16 are perspective views exemplifying the prior art discussed in the fourth, fifth, and sixth paragraphs under "Background of the Invention" hereinbefore.
Figure 15:
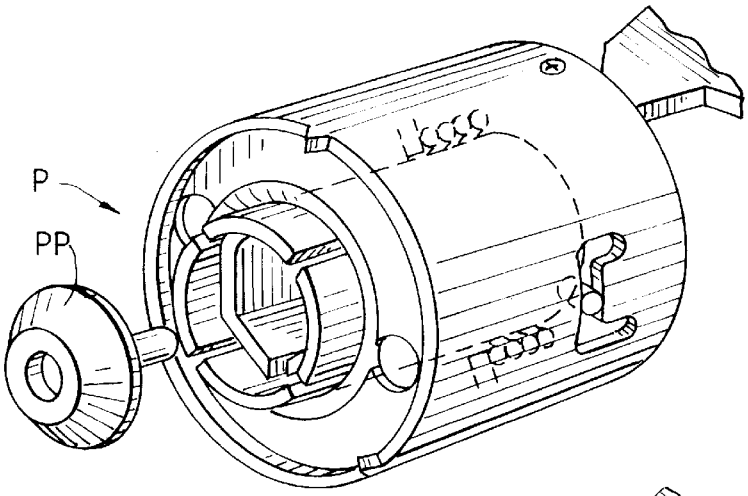
FIG. 15 PRIOR ART
Figure 16:
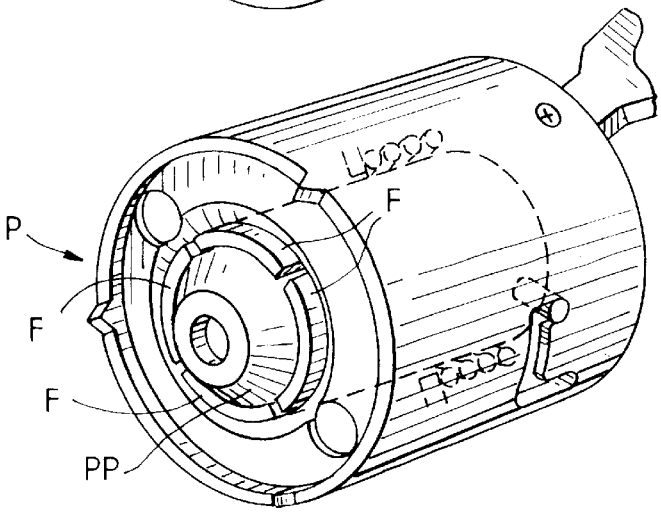
FIG. 16 PRIOR ART

As shown in FIG. 7, the fastener-driving tool 10 is being used to drive a steel pin 12 from the nosepiece 14, through a polymeric plug 20', through a dimpled membrane 30' at a selected dimple 32', to a foundation wall 40', which is similar to the foundation wall 40. The membrane 30 is shown in FIG. 7 as having been fastened to the foundation wall 40' via a similar pin 12 driven through a similar plug and has having been fastened thereto, along an upper edge 34' of the membrane 30, via similar pins 12 driven through steel washers 36', through a steel batten 38', into the foundation wall 40'.

As shown in FIG. 7, the membrane 30' is formed from a sheet of high density polyethylene (HDPE) so as to have a rectangular array of similar dimples 32', each having a generally frusto-conical shape, and is intended to represent the "System Platon" membranes described above as being available commercially from Big "O", Inc. Such "System Platon" membranes are advertised as having a minimum 24 mil thickness and as creating a ¼ inch air gap or drainage space. The dimples 32' are closed except where selected dimples 32' are penetrated by the pins 12. The plugs 20' seal the dimples 32' that are penetrated by the pins 12.

As shown in FIGS. 1, 2, and 5, each plug 20' is molded from a suitable polymer, such as high density polyethylene, so as to have a generally frusto-conical body and a unitary stem 22', and is intended to represent the polymeric plugs described above as being available commercially from Big "O", Inc., for such "System Platon" membranes. Defining an axis, each plug 20' has a preformed hole 24', which extends axially through such plug 20' and through the unitary stem 22' and through which such a pin 12 can be forcibly driven. Further details of the membrane 30' and the plugs 20' are outside the scope of this invention and can be readily supplied by persons having ordinary skill in the art.

Preferably, as shown in FIG. 7 and as discussed above, the steel pin 12 is fed into the tool 10 via a strip 42, in which a large number of such pins 12 are carried by polymeric sleeves 44, as illustrated and described in Ernst et al. U.S. Pat. No. 5,069,340. As shown in FIG. 8, a collar 46' is formed around the shank of the steel pin 12, between the head of the steel pin 12 and the steel washer 36', from residue of the strip 42. As shown in FIG. 9, a collar 48' is formed around the shank of the steel pin 12, between the collar 46' formed from residue of the strip 42 and the generally frusto-conical body of the polymeric plug 20', from the unitary stem 22'.

As shown in FIGS. 7 through 13, the workpiece-contacting probe 200 in its second embodiment includes a mounting bracket 202, which is similar to the mounting bracket 102 and which is mounted similarly to the actuating member 18, a tubular body 210, which is fixed to the mounting bracket 202, and a plug-holding member 220, which is mounted removably to the tubular body 210 in a manner described below. Except for the plug-holding member 220, the workpiece-contacting probe 200 is similar to the workpiece-contacting probe disclosed in Gupta U.S. Pat. No. 5,484,094.

Thus, the tubular body 210 includes two permanent magnets 212, which are positioned in axially extending sockets 214 on opposite sides of the tubular body 212. As shown in FIG. 13, the permanent magnets 212 are adapted to hold a steel washer 36' when the plug-holding member

220 is removed, if the steel washer 36' is made from a magnetizable steel, for fastening of the dimpled membrane 30' along its upper edge 34'.

The plug-holding member 220, which is made from a magnetizable steel, is adapted to be removably mounted to the tubular body 210 and to be magnetically held by the permanent magnets 212 when mounted to the tubular body 210. As shown in FIG. 9, the tubular body has a tubular wall 222 defining an axis and has an annular structure 224 projecting inwardly from the tubular wall 222 and adapted to be magnetically held by the permanent magnets 212 when the plug-holding member 220 is mounted to the tubular body 210. The tubular wall 222 and the annular structure 224 define an inner recess 228, which is adapted to receive the tubular body 210 when the plug-holding member 220 is mounted to the tubular body 210.

The tubular wall 222 and the annular structure 224 define an outer recess 230, which is adapted to receive a polymeric plug 20'. Further, the plug-holding member 220 has two pointed pins 240 extending and force-fitted through pin-receiving holes 242 in the tubular wall 222, in diametric opposition to each other. Each pin 240 has a point 244 projecting inwardly from the tubular wall 222 so as to press against a polymeric plug 20' when received in the recess 230. The pins 240 are similar to the pins 130 and function similarly. As evident from FIG. 12, the pins 240 hold the polymeric plug 20' in the recess 230, by projecting inwardly from the tubluar wall 222 for a sufficient distance to prevent the polymeric plug 20' from exiting the recess 230 until the polymeric plug 20' is driven from the recess.

Being molded from high density polyethylene, each polymeric plug 20' exhibits sufficient resiliency to enable such polymeric plug 20' to be snap-fitted past the points 244, not only when pressed manually into the recess 230 but also when driven forcibly from the recess 230 by a steel pin 12 being driven forcibly by the fastener-driving tool 10, without any significant damage to such polymeric plug 20'. As evident from FIG. 12, a polymeric plug 20' has an axial length greater than the axial depth of the recess 230 so as to project axially from the recess 230 when pressed into the recess 230, whereby to facilitate centering of the projecting plug 20' in a dimple 32'.

Each embodiment described above provides significant improvements when compared to the aforementioned attempt that was made in the prior art to adapt the workpiece-contacting probe illustrated and described in Gupta U.S. Pat. No. 5,484,094 by providing a collet having several plug-holding fingers intended to hold a polymeric plug. Each embodiment described above has a lesser tendency to become plugged with mud or debris. Each embodiment described above works satisfactorily over a wide range of dimensional tolerances of the polymeric plugs available commercially.

Various modifications may be made in either of the first and second embodiments described above without departing from the scope and spirit of this invention.

What is claimed is:

1. A fastener-driving tool useful to fasten a dimpled membrane to a foundation wall, via a fastener and a polymeric plug, the fastener-driving tool comprising (a) a nosepiece, (b) means for driving the fastener from the nosepiece, through the polymeric plug and through the dimpled membrane, into the foundation wall, (c) an actuating member mounted movably on said tool and movable thereon between an extended, tool-disabling position and a retracted, tool-enabling position, and (d) a workpiece-contacting probe mounted to the actuating member so as to be conjointly movable with the actuating member, wherein the workpiece-contacting probe includes means including a plug-holding member for holding the polymeric plug as the fastener is being driven through the polymeric plug, the plug holding member having a tubular wall defining a recess that receives the polymeric plug within the recess so that the tubular wall surrounds the polymeric plug, the plug-holding member having at least one pointed element having a point projecting inwardly from and non-movably in relation to the tubular wall, the point constituting means for holding the polymeric plug when the polymeric plug is received in the recess, wherein the workpiece-contacting probe includes a mounting bracket mounted to the actuating member and a tubular body fixed to the mounting bracket, the tubular body including at least one permanent magnet positioned at one side of the tubular-body, the plug-holding member being mounted removably to the tubular body and being held magnetically by the at least one permanent magnet when mounted to the tubular-body, wherein the at least one permanent magnet holds a steel washer, which is made of a magnetizable steel, when the plug-holding member is removed, and wherein the plug-holding member has a tubular portion adapted to fit around the tubular body when the plug-holding member is mounted to the tubular body.

2. The fastener-driving tool of claim 1 wherein the at least one pointed element comprises a pair of pointed elements in diametric opposition to each other, each having a point projecting inwardly from the tubular wall, into the recess, so as to press against the polymeric plug when the polymeric plug is received in the recess.

3. The fastener-driving tool of claim 2 wherein each pointed element comprises a pointed pin extending through the tubular wall and having a point projecting inwardly from the tubular wall, into the recess.

4. The fastener-driving tool of claim 1 wherein the recess defines an axis and has an axial depth, said tool further comprising a polymeric plug received by the recess, the polymeric plug defining an axis and having an axial length greater than the axial depth of the recess so as to project axially from the recess.

5. A fastener-driving tool useful to fasten a dimpled membrane to a foundation wall, via a fastener and a polymeric plug, the fastener-driving tool comprising (a) a nosepiece, (b) means for driving the fastener from the nosepiece, through the polymeric plug and through the dimpled membrane, into the foundation wall, (c) an actuating member mounted movably on said tool and movable thereon between an extended, tool-disabling position and a retracted, tool -enabling position, and (d) a workpiece-contacting probe mounted to the actuating member so as to be conjointly movable with the actuating member, wherein the workpiece-contacting probe includes means including a plug-holding member for holding the polymeric plug as the fastener is being driven through the polymeric plug, the plug holding member having a tubular wall defining a recess that receives the polymeric plug within the recess so that the tubular wall surrounds the polymeric plug, the plug-holding member having at least one pointed element having a point projecting inwardly from and non-movably in relation to the tubular wall, the point constituting means for holding the polymeric plug when the polymeric plug is received in the recess, wherein the workpiece-contacting probe includes a mounting bracket mounted to the actuating member and a tubular body fixed to the mounting bracket, the tubular body including a pair of permanent magnets positioned at one side of the tubular-body, the plug-holding member being mounted removably to the tubular body and being held magnetically by the permanent magnets when mounted to the tubular-body, wherein the magnets hold a steel washer, which is made of a magnetizable steel, when the plug-holding member is removed, and wherein the plug-holding member has a tubular portion adapted to fit around the tubular body when the plug-holding member is mounted to the tubular body.

* * * * *